United States Patent [19]

Kuo

[11] Patent Number: 4,682,139

[45] Date of Patent: Jul. 21, 1987

[54] ELECTRICAL AUTOMOBILE PLUG

[76] Inventor: Jung-Tsan Kuo, No. 20, Her Chung Street, Tainan, Taiwan

[21] Appl. No.: 897,031

[22] Filed: Aug. 15, 1986

[51] Int. Cl.[4] ..... H01H 85/02; H01H 85/52

[52] U.S. Cl. ..... 337/186; 337/216

[58] Field of Search ..... 337/186, 187, 188, 198, 337/213, 216, 227, 228; 339/147 P, 197 P, 208

[56] References Cited

U.S. PATENT DOCUMENTS 4,322,122 3/1982 Schwartz et al. ..... 339/147 P

*Primary Examiner*—Harold Broome

*Attorney, Agent, or Firm*—Morton J. Rosenberg

[57] ABSTRACT

An electrical plug which has a spring-loaded contact connecting electrically to a first conducting strip acting as an anode and a second conducting strip acting as a cathode. Both the first and second conducting strips have sharp projections which penetrate into conducting wires to contact the conductor therein. The cathode conducting strip has a resilient ridge projecting therefrom to contact the negative polarity of the electricity system of automobiles, thus keeping the plug from dropping out of the socket. If necessary, a fuse is provided between the anode conducting strip and the spring to limit electrical current and protect the plug. The manufacturer has the choice of whether or not to use a fuse in accordance with the different requirements of different electrical appliances.

2 Claims, 5 Drawing Figures

ELECTRICAL AUTOMOBILE PLUG

BACKGROUND OF THE PRESENT INVENTION

Conventionally, some electrical plugs for automobiles have had one or more fuses disposed therein and others have no fuse. In order to produce both the plugs having fuse and that having no plug, a manufacture needs at least the different assembly lines. This increases the cost.

In addition, previously, wires were soldered to the contacts and/or conducting strips in conventional automobile plugs. Without doubt, the soldering requires additional labor and thus increases manufacturing cost.

SUMMARY

It is the primary object of the present invention to provide an electrical plug which offers two different structure, consisting of a fuse or no fuse.

It is another object of the present invention to provide an electrical plug which works well, regardless of whether a fuse is used or not.

The advantages of such a design are:

(1) Saving parts storing space and cost, since the parts for two types of plugs are almost the same, and (2) Easy to manufacture, thus, reducing labor cost.

DETAILED DESCRIPTION OF THE PREFERRED EMBODIMENT

This invention relates to an electrical plug for automobiles.

Figure 1:
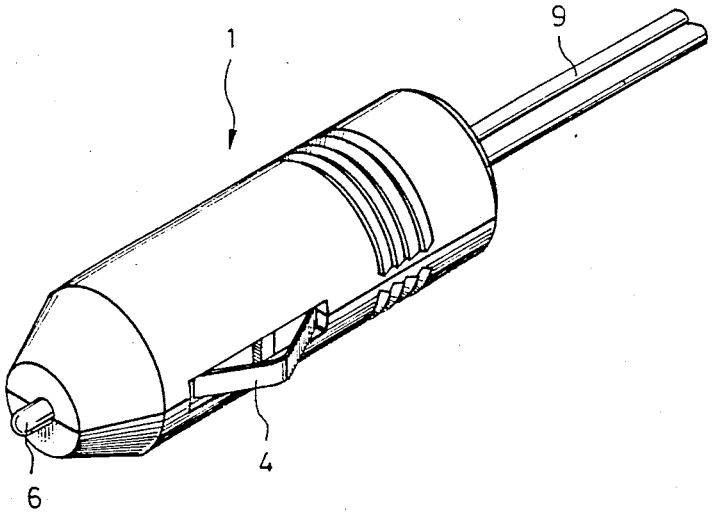
FIG. 1 is a perspective view of an electrical plug in accordance with the present invention.
Figure 2:
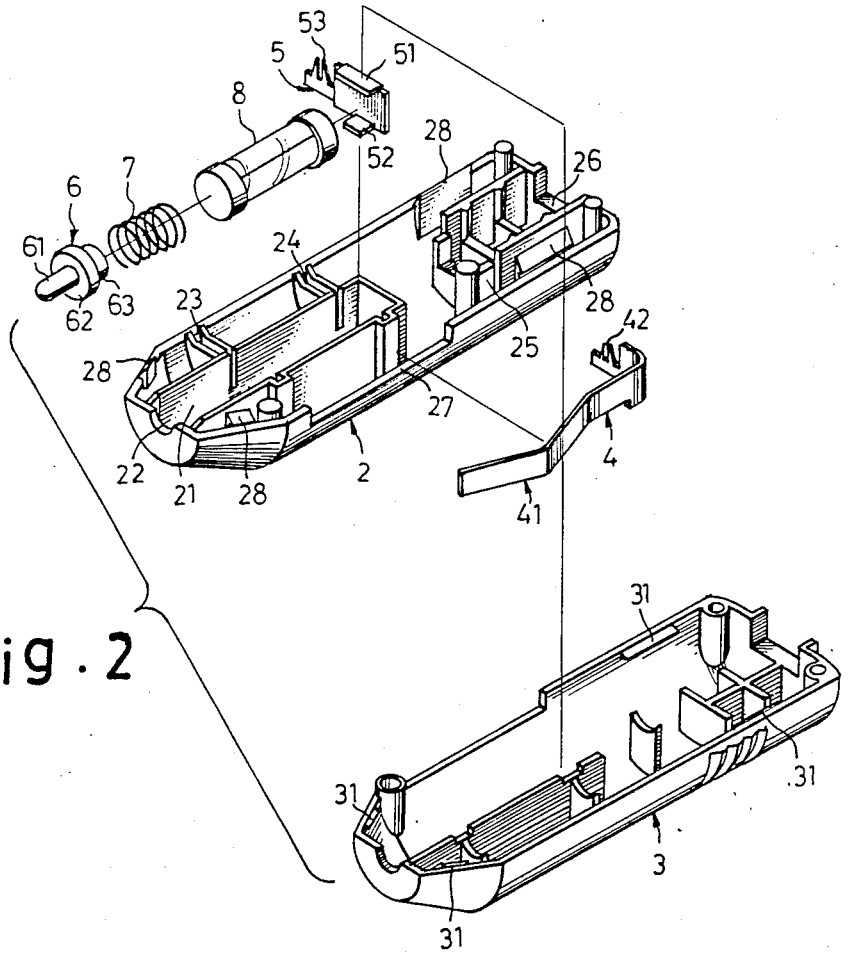
FIG. 2 is a fragmental view of the electrical plug shown in FIG. 1.

Referring to the drawings and in particular to FIG. 1 and 2, it can be seen that the electrical plug 1 in accordance with the present invention comprises a base 2, a cover 3, two conducting strips 4 and 5, a contact 6 and a spring 7.

Figure 3:
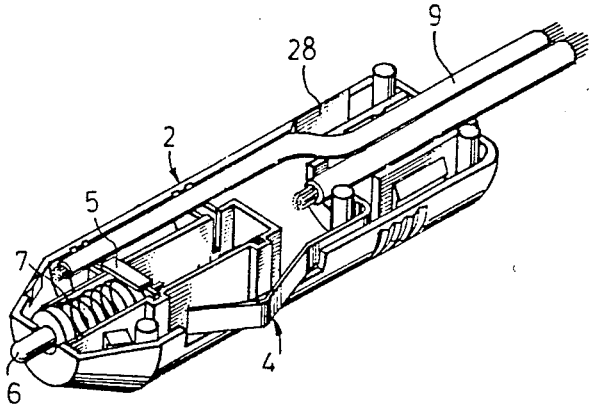
FIG. 3 is a view of the electrical plug shown on FIG. 1, with the cover removed; and no fuse contained therein.

The base 2 has, on one end, an elongated seat 21 capable of holding the spring 7 and a fuse 8. The base 2 has a hole 22 on one end of the seat 21 to allow contact 6 to be disposed therein. Disposed on one side of the elongated seat 21 are two slots 23 and 24, one of which receives the second conducting strip 5. On the other end of the base 2, a recess 26 is disposed for receiving a pair of wires 9 (FIG. 1 and 3). Disposed between the recess 26 and the seat 21 is a holding seat 25 for receiving and holding the first conducting strip 4. In order to expose the first conducting strip 4, an elongated hole 27 is provided, corresponding to the holding seat 25, on one longitudinal side of the base 2.

The contact 6 has a disk 62 which further has a slender post 61 projecting therefrom. The diameter of the post 61 matches the inside diameter of the hole 22 and the post 61 is placed in the hole 22 to contact the anode of a socket on the car dashboard (not shown). The disk 62 further has an inner rim 63, opposite to the post 61, for receiving the spring 7. As shown on FIG. 3, if no fuse is used, spring 7 will contact the second conducting strip 5 directly, with conducting strip 5 disposed on the first slot 23, which is proximate to the hole 22. When the fuse 8 is used, as shown on FIG. 4, the second conducting strip 5 will be placed on the second slot 24 which is remote from the hole 22; the fuse 8 is then placed between the spring 7 and the second conducting strip 5. The second conducting strip 5 has two retaining folds 51 and 52 to keep the fuse 8 or spring 7 therebetween. The conducting strip 5 further has sharp projection 53 to pierce into the wire 9 and make contact with the conductor therein.

The first conducting strip 4 is L-shaped with an outward resilient ridge 41 on one end and sharp projections 42 on the other end. The first conducting strip 4 is disposed on the holding seat 25 with the ridge 41 thereof within and beyond the elongated hole 27 to resiliently contact the cathode of the socket on car dashboard (not shown).

Figure 4:
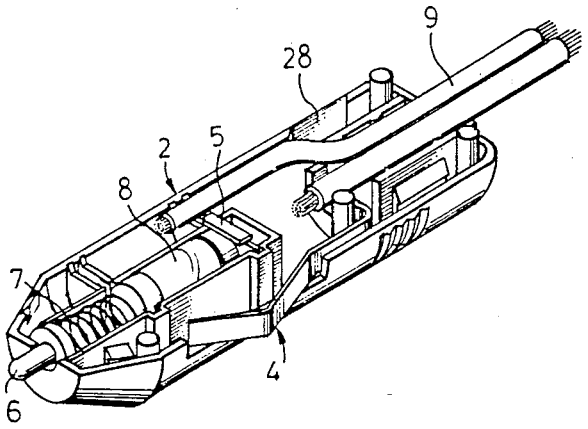
FIG. 4 is a view of the electrical plug shown on FIG. 3 with a fuse contained therein.

In FIG. 3 and 4, a pair of wires 9 are shown in recess 26 with the ends thereof being pierced into by the sharp projections 53 and 42 (see FIG. 2).

Figure 5:
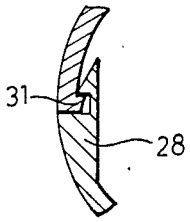
FIG. 5 shows the joint of the base and the cover of the electrical plug shown on FIG. 1.

The base 2 is further provided with engaging means 28 which engages with the counterpart 31 thereof disposed on the cover 3 so as to securely fix the base 2 and the cover 3 together. The engagement between the two engagement means 28 and 31 is shown in FIG. 5. Since this type of engagement is familiar to those having ordinary skills in the art, it will not be further described herein.

I claim:

1. An electrical plug comprising a base, a cover, first and second conducting strips, a contact and a spring, said base having a seat at the middle position therewithin to receive and keep the first conducting strip therein; said base further having a first hole to expose part of said first conducting strip to act as cathode of said plug; said base also having an elongated seat capable of holding a fuse disposed proximate to one end thereof with a second hole on said one end; said contact having a slender post disposed on said hole which acts as an anode; said contact further having a spring holding means to hold the spring thereon; said base also having a means for holding said second conducting strip, including two slots are disposed on one side of said elongated seat with the first slot proximate to the second hole and the second slot remotely positioned from the second hole such that when said second conducting strip is placed at the first slot, said spring electrically contacts the second conducting strip, while when said second conducting strip is placed at the second slot, a fuse providable in said elongated seat is also placed between the spring and the second conducting strip so as to provide protection.

2. An electrical plug as set forth in claim 1, wherein each of said conducting strips has a sharp projection piercing into the wires therein so as to electrically contact the conductor portion of said wires.

* * * * *